United States Patent [19]

Rybak

[11] 4,378,548

[45] Mar. 29, 1983

[54] LIFTING MAGNET INCORPORATING COOLING MEANS

[75] Inventor: James P. Rybak, Solon, Ohio

[73] Assignee: Magnetics International, Inc., Maple Heights, Ohio

[21] Appl. No.: 246,651

[22] Filed: Mar. 23, 1981

[51] Int. Cl.[3] ..... H01F 7/20

[52] U.S. Cl. ..... 335/291; 335/300

[58] Field of Search ..... 335/289, 291, 292, 300

[56] References Cited

U.S. PATENT DOCUMENTS 923,653 6/1909 Hillard et al. ..... 335/291

3,693,126 9/1972 Rybak ..... 335/291

4,103,266 7/1978 Schwartz ..... 335/289

FOREIGN PATENT DOCUMENTS 507394 12/1951 France ..... 335/291

166951 7/1921 United Kingdom ..... 335/291

*Primary Examiner*—George Harris

*Attorney, Agent, or Firm*—Thomas H. Murray

[57] ABSTRACT

A lifting magnet for warm steel slabs and the like incorporating means for cooling the metallic shell of the magnet to prevent damage to coil insulation due to overheating.

2 Claims, 2 Drawing Figures

AIR CONDITIONING
31
32
10
14
12
16
24
26
22
20
34
28
30
18

10
30
30
II
II
30
34
12

LIFTING MAGNET INCORPORATING COOLING MEANS

BACKGROUND OF THE INVENTION

Lifting magnets have been used in the steel industry for many years and comprise a large circular shell formed from magnetically-permeable material (e.g., iron or low-carbon steel) which houses an electrical coil. Such magnets are sometimes used to lift steel plates or the like which are at relatively high temperatures. A steel workpiece, of course, cannot be lifted when its temperature is above the Curie point (about 1400° F.) where it is no longer magnetic; however modern-day steelmaking practices dictate a need to lift the workpieces at higher and higher temperatures. This presents a problem in maintaining the electrical coil within the housing at a temperature where its insulation will not become damaged, particularly since it is surrounded by an iron or the like shell of high heat conductivity characteristics which is in contact with the hot workpiece.

SUMMARY OF THE INVENTION

In accordance with the present invention, means are provided for cooling a lifting magnet with the use of a cooling fluid, preferably a gas, which flows through one or more passageways in the magnet to a space between plates which act as a cover for the coil carried within the shell. These plates are in thermal contact with the shell itself and, consequently, heat is transferred from the shell to the plates and then to the cooling fluid, thereby maintaining the temperature of the magnet structure at a point where damage to coil insulation will not occur.

Specifically, there is provided a lifting magnet comprising a shell of magnetically-permeable material, an annular cavity formed in the bottom of the shell, an electromagnetic coil received within the cavity, spaced annular plates on the bottom of the shell covering the coil and cavity, and means for directing a cooling fluid into the space between the plates.

The above and other objects and features of the invention will become apparent from the following detailed description taken in connection with the accompanying drawings which form a part of this specification, and in which.

With reference now to the drawings, the magnet shown includes a circular shell or housing 10 formed from magnetically-permeable material such as iron or mild steel. The shell is normally suspended from a crane hook, not shown. Instead of forming the shell from a casting, it is also possible to fabricate it from low-carbon steel plate.

Figure 2:
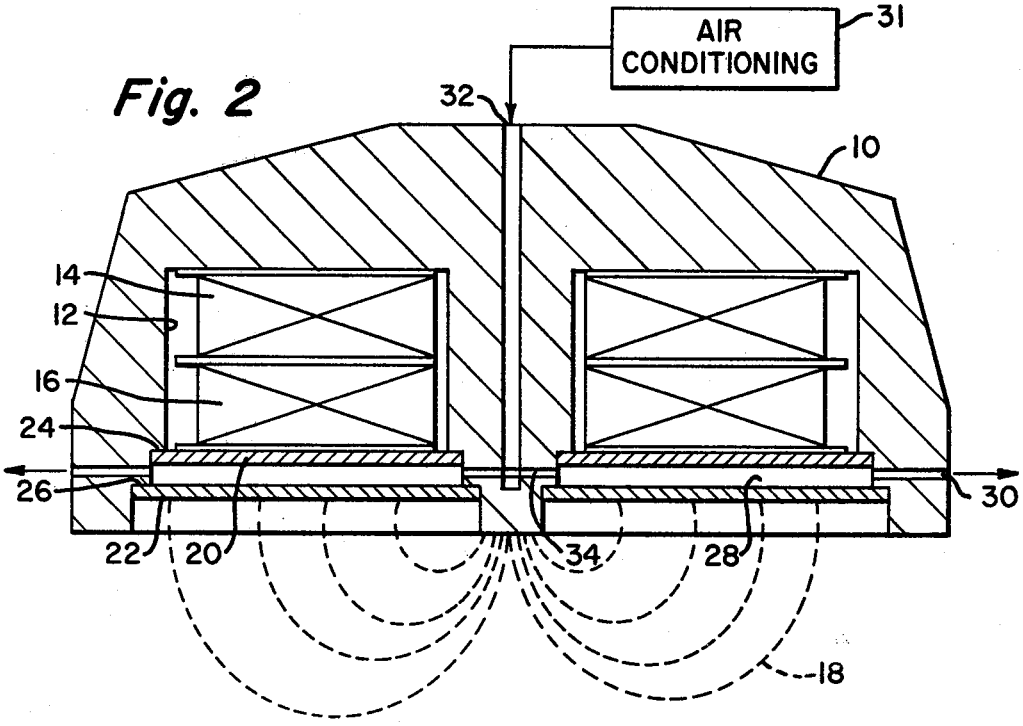
FIG. 2 is a cross-sectional view taken substantially along line II—II of FIG. 1.
Figure 1:
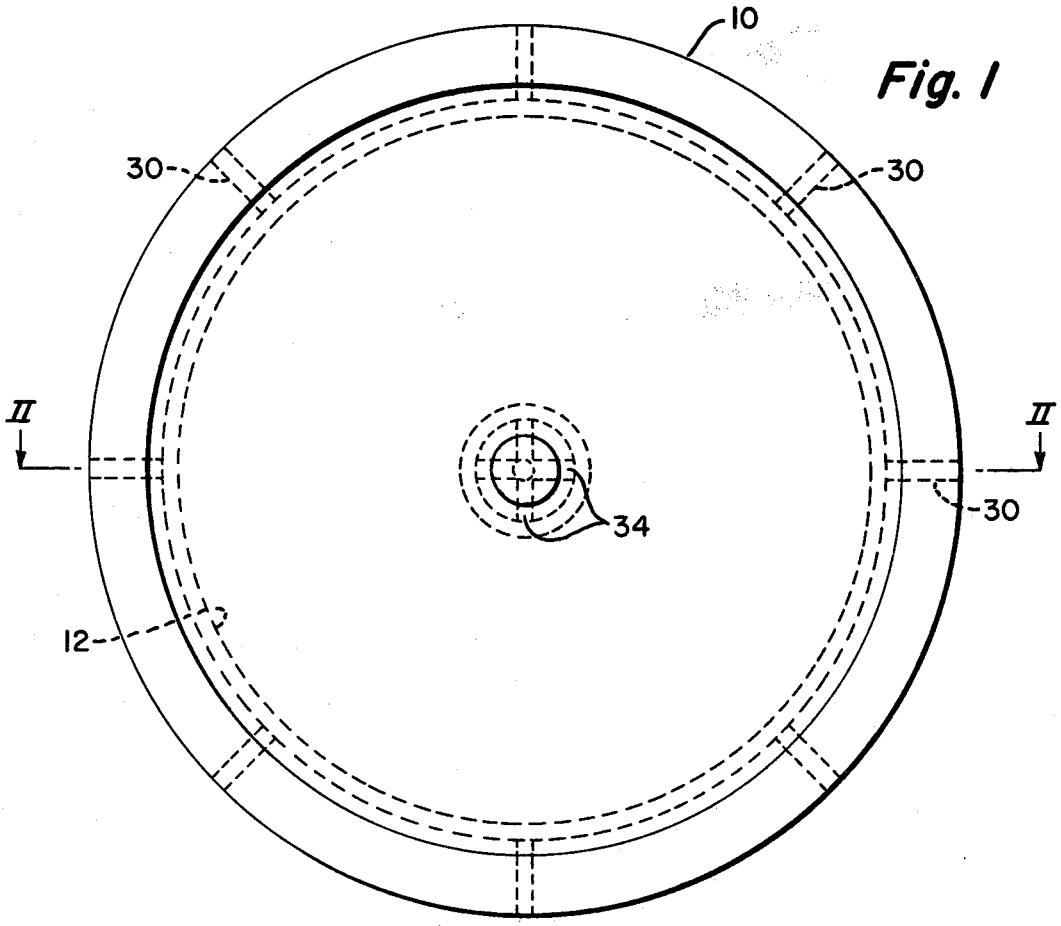
FIG. 1 is a top view of the lifting magnet of the invention.

Formed in the bottom of the shell 10 is an annular cavity 12 which receives a pair of electromagnetic coils 14 and 16. The coils 14 and 16 are coaxial and, when energized, will produce a magnetic flux field generally designated by the reference numeral 18 in FIG. 2. Covering the annular cavity 12 and coils 14 and 16 therein are spaced annular plates 20 and 22 which are secured to flanges 24 and 26, respectively. The plates 20 and 22 are normally formed from high manganese steel which is not ferromagnetic such that the line of flux 18 will readily pass therethrough and into a steel workpiece which is to be lifted by the magnet.

As was explained above, when a magnet such as that shown in the drawings is utilized to lift hot workpieces whose temperatures may be not too far below the Curie point, heat will be transferred to the shell 10 and the coils 14 and 16; and this may result in severe damage to the coil insulation. In accordance with the present invention, a fluid is forced into the space 28 between the plates 20 and 22 to cool the shell 10 as well as the coils 14 and 16. Specifically, cool air from an air conditioner 31, for example, is forced into a central bore 32 formed in the shell 10. From the bore 32, it is radially distributed via passageways 34 into the annular space 28 and then exits through radially-extending passageways 30 in the periphery of the shell 10. Air is preferably used as the cooling medium rather than a liquid to minimize any danger of explosion.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A lifting magnet for heated workpieces formed from magnetically-permeable material, comprising a shell of magnetically-permeable material, a single annular cavity formed in the bottom of said shell, an electromagnetic coil received within said cavity, spaced annular plates through which lines of flux will pass on the bottom of said shell, said plates covering said coil and cavity and forming a single unobstructed annular space therebetween, means for causing a cooling fluid to flow through said space in a radial direction only, and radial passageways in the outer periphery of said shell for exhausting cooling fluid from said annular space between the plates.

2. The lifting magnet of claim 1 including a passageway extending substantially along the axis of said shell, and radial passageways communicating with said axial passageway for directing cooling fluid from the axial passageway into said annular space for radial outward movement through the annular space.

* * * * *